US008034752B2

(12) United States Patent
Freeman et al.

(10) Patent No.: US 8,034,752 B2
(45) Date of Patent: Oct. 11, 2011

(54) LUBRICATING COMPOSITION

(75) Inventors: Traci Freeman, Mechanicsville, VA (US); William Y. Lam, Glen Allen, VA (US); Gregory P. Anderson, Midlothian, VA (US)

(73) Assignee: Afton Chemical Corporation, Richmond, VA (US)

( * ) Notice: Subject to any disclaimer, the term of this patent is extended or adjusted under 35 U.S.C. 154(b) by 497 days.

(21) Appl. No.: 12/045,926

(22) Filed: Mar. 11, 2008

(65) Prior Publication Data

US 2009/0233820 A1 Sep. 17, 2009

(51) Int. Cl.
*C10M 169/04* (2006.01)
*C10G 71/00* (2006.01)

(52) U.S. Cl. ..... 508/110; 208/19

(58) Field of Classification Search ..... 508/110; 208/19

See application file for complete search history.

(56) References Cited

U.S. PATENT DOCUMENTS

| | | | | |
|---|---|---|---|---|
| 6,869,917 | B2 * | 3/2005 | Deckman et al. | 508/110 |
| 2005/0261147 | A1 * | 11/2005 | Rosenbaum et al. | 508/466 |
| 2007/0238627 | A1 | 10/2007 | Haire et al. | |

FOREIGN PATENT DOCUMENTS

| | | | |
|---|---|---|---|
| GB | 2307243 | A | 5/1997 |
| WO | 2007063125 | A | 6/2007 |

OTHER PUBLICATIONS

European search report, European Patent Office, European Patent Application No. 08168674.3, Aug. 27, 2009.

* cited by examiner

*Primary Examiner* — Walter Griffin
*Assistant Examiner* — Frank C Campanell
(74) *Attorney, Agent, or Firm* — Luedeka, Neely & Graham, P.C.

(57) ABSTRACT

There is disclosed a lubricating composition comprising a first base oil having a kinematic viscosity at 100° C. ranging from about 3.5 cSt to about 6 cSt; and a second high viscosity base oil having a kinematic viscosity at 100° C. ranging from about 6 cSt to about 17 cSt.

15 Claims, No Drawings

LUBRICATING COMPOSITION

DESCRIPTION OF THE DISCLOSURE

1. Field of the Disclosure

The present disclosure relates to a lubricating composition comprising a first base oil having a kinematic viscosity ranging from about 3.5 cSt to about 6 cSt, and second high viscosity base oil having a kinematic viscosity ranging from about 6 cSt to about 17 cSt, and methods of use thereof.

2. Background of the Disclosure

With the recent upgrades in lubricating composition specifications, blenders are faced with the challenge of changing the way motor oils are formulated. For example, lubricating compositions that are suitable for use in modern engines must meet certain minimum performance standards, such as the International Lubricant Standardization and Approval Committee (ILSAC) GF-4 standard and the American Petroleum Institute (API) SM standard. Additionally, some original equipment manufacturers (OEM) demand higher performance levels for certain families of engines, as imposed by internal OEM specifications. For example, General Motors has recently issued a proposed GEOS A specification that requires higher minimum standards in certain aspects than the ILSAC GF-4 standard. However, to achieve these standards, blenders often incorporate numerous additives, such as detergents and/or expensive base oils, which can increase the overall manufacturing cost. Thus, a need exists to find alternative ways to achieve passing performance on standard tests and OEM specifications in lubricating compositions, such as passenger car and heavy-duty engine oils, without significantly increasing the overall manufacturing cost.

It has now been found that incorporating a second high viscosity base oil can greatly improve the capability of a lubricating composition to achieve ILSAC and API minimum performance standards. It has further been found that the lubricating compositions of the present disclosure can exhibit improved viscosity control and deposit formation.

SUMMARY OF THE DISCLOSURE

In accordance with the disclosure, there is disclosed a lubricating composition comprising a first base oil having a kinematic viscosity at 100° C. ranging from about 3.5 cSt to about 6 cSt, and a second high viscosity base oil having a kinematic viscosity ranging from about 6 cSt to about 17 cSt.

There is also disclosed a method of controlling oil thickening of a lubricating composition, said method comprising admixing a major amount of a first base oil having a kinematic viscosity at 100° C. ranging from about 3.5 cSt to about 6 cSt with a minor amount of a second high viscosity base oil having a kinematic viscosity at 100° C. ranging from about 6 cSt to about 17 cSt.

There is further disclosed a method of controlling piston deposit formation, said method comprising providing to the pistons in an automotive engine a lubricating composition comprising a first base oil having a kinematic viscosity at 100° C. ranging from about 3.5 cSt to about 6 cSt, and second high viscosity base oil having a kinematic viscosity ranging from about 6 cSt to about 17 cSt.

Additionally, there is disclosed a method of reducing valve train wear, said method comprising providing to the valve train of an automotive engine a lubricating composition comprising a first base oil having a kinematic viscosity at 100° C. ranging from about 3.5 cSt to about 6 cSt, and second high viscosity base oil having a kinematic viscosity ranging from about 6 cSt to about 17 cSt.

Further, there is disclosed a method of lubricating an automotive engine, said method comprising adding to and operating in the crankcase of said automotive engine a lubricating composition comprising a first base oil having a kinematic viscosity at 100° C. ranging from about 3.5 cSt to about 6 cSt, and second high viscosity base oil having a kinematic viscosity ranging from about 6 cSt to about 17 cSt.

Additional objects and advantages of the disclosure will be set forth in part in the description which follows, and/or can be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

DESCRIPTION OF THE EMBODIMENTS

The present disclosure relates to a lubricating composition comprising a first base oil having a kinematic viscosity at 100° C. ranging from about 3.5 cSt to about 6 cSt, and second high viscosity base oil having a kinematic viscosity at 100° C. ranging from about 6 cSt to about 17 cSt. Moreover, there are disclosed methods of use thereof.

The lubricating compositions of this disclosure can comprise a first base oil based on natural or synthetic oils, or blends thereof, provided the base oil has a suitable viscosity for use in lubricating compositions, such as passenger car motor oils (PCMO), automatic transmission fluids (ATF), heavy-duty engine oils, turbine oils, hydraulic fluids, gear oils, and other industrial fluids. In an aspect, the first base oil can have a kinematic viscosity at 100° C. ranging from about 3.5 cSt to about 6 cSt, such as from about 4 cSt to about 5.5 cSt. Thus, suitable automotive oils can include, but are not limited to, multigrades, such as 0W-20, 0W-30, 0W-40, 5W-20, 5W-30, 5W-40, 10W-30, 10W-40, and the like.

Suitable first base oils for use in the present disclosure can be made using a variety of different processes including but not limited to distillation, solvent refining, hydrogen processing, oligomerization, esterification, and re-refining. Suitable first base oils can comprise Group I-IV basestocks, as classified by API 1509 "Engine Oil Licensing and Certification System" Sixteenth Edition, April 2007:

Group I contain less than 90% saturates and/or greater than 0.03% sulfur and have a viscosity index greater than or equal to 80 and less than 120;

Group II contain greater than or equal to 90% saturates and less than or equal to 0.03% sulfur and have a viscosity index greater than or equal to 80 and less than 120;

Group III contain greater than or equal to 90% saturates and less than or equal to 0.03% sulfur and have a viscosity index greater than or equal to 120;

Group IV are polyalphaolefins (PAO); and

The test methods used in defining the above groups are ASTM D 2007 for saturates; ASTM D 2270 for viscosity index; and one of ASTM D 1552, 2622, 3120, 4294, and 4927 for sulfur.

Group IV basestocks, i.e. polyalphaolefins (PAO) include hydrogenated oligomers of an alpha-olefin, the most important methods of oligomerization being free radical processes, Ziegler catalysis, and cationic, Friedel-Crafts catalysis.

The polyalphaolefins typically have viscosities in the range of 2 to 100 cSt at 100° C., for example 4 to 8 cSt at 100° C. They can, for example, be oligomers of branched or straight chain alpha-olefins having from 2 to 16 carbon atoms, specific examples being polypropenes, polyisobutenes, poly-1-butenes, poly-1-hexenes, poly-1-octenes and poly-1-decene. Included are homopolymers, interpolymers and mixtures.

In another aspect, the first base oil can be chosen from a Group I base oil, Group II base oil, Group II+ base oil, Group III base oil, Group IV base oil, and mixtures thereof.

Typically, the lubricating compositions can contain a major amount of a first base oil. A "major amount" is understood to mean greater than or equal to 50% by weight relative to the total weight of the lubricating composition. For example, the first base oil can be present in the lubricating composition in an amount ranging from about 60 about 100 percent by weight, and as a further example from about 75 to about 95 percent by weight The lubricating compositions of this disclosure can comprise a second high viscosity base oil based on natural or synthetic oils, or blends thereof, provided the base oil has a suitable viscosity for use in lubricating compositions, such as passenger car motor oils (PCMO), heavy-duty engine oils, turbine oils, hydraulic fluids, gear oils, and other industrial fluids. In an aspect, the second high viscosity base oil can have a kinematic viscosity at 100° C. ranging from about 6 cSt to about 17 cSt, such as from about 8 cSt to about 14 cSt. Suitable automotive oils can include, but are not limited to, multigrades, such as 0W-20, 0W-30, 0W-40, 5W-20, 5W-30, 5W-40, 5W-30, 10W-40, and the like.

Suitable second high viscosity base oils for use in the present disclosure can be made using a variety of different processes including but not limited to distillation, solvent refining, hydrogen processing, oligomerization, esterification, and re-refining.

In another aspect, the second high viscosity base oil can be chosen from a Group I base oil, Group II base oil, Group II+ base oil, Group III base oil, and Group IV base oil, such as a Group II or Group II+ base oil. In a further aspect, the lubricating compositions of this disclosure can be substantially free of expensive base oils, such as Group III, IV, and V base oils. As used herein, "substantially free" is understood to mean containing at most trace amounts of a substance (e.g., less than 0.5 wt. %).

The lubricating compositions can comprise a minor amount of a second high viscosity base oil. As used herein, a "minor amount" is understood to mean less than 50% by weight, relative to the total amount of the lubricant composition. In an aspect, the second high viscosity base oil can be present in the disclosed lubricating compositions in an amount ranging from about 1% to about 49% by weight, such as from about 5% to about 15% by weight, relative to the total amount of the lubricant composition.

The disclosed lubricant compositions can comprise at least one additive known to those of ordinary skill in the art. Non-limiting examples of additional additives include antiwear agents, friction modifiers, antioxidants, dispersants, detergents, rust inhibitors, corrosion inhibitors, demulsifiers, dispersant inhibitors, pour point depressants, viscosity index improvers, antifoaming agents, seal swell agents, dispersant-inhibitor packages, and the like. In an aspect, the lubricating compositions of this disclosure can be substantially free of low-base detergents, such as those having a TBN ranging from about 10 to about 100.

In an aspect, the lubricating composition of this disclosure can exhibit increased viscosity control, as compared to a lubricating composition devoid of the second high viscosity base oil. In another aspect, the lubricating composition of this disclosure can exhibit reduced deposit formation, such as piston deposit formation, as compared to a lubricating composition devoid of the second high viscosity base oil.

In an embodiment, there is disclosed a method of controlling oil thickening of a lubricating composition, said method comprising admixing a major amount of a first base oil having a kinematic viscosity at 100° C. ranging from about 3.5 cSt to about 6 cSt with a minor amount of a second high viscosity base oil having a kinematic viscosity at 100° C. ranging from about 6 cSt to about 17 cSt.

In another embodiment, there is disclosed a method of controlling deposit formation in an engine, said method comprising providing to said engine a lubricating composition comprising a first base oil having a kinematic viscosity at 100° C. ranging from about 3.5 cSt to about 6 cSt; and a second high viscosity base oil having a kinematic viscosity at 100° C. ranging from about 6 cSt to about 17 cSt.

Further, there is disclosed herein a method of reducing valve train wear, said method comprising providing to the valve train of an automotive engine a lubricating composition comprising a first base oil having a kinematic viscosity at 100° C. ranging from about 3.5 cSt to about 6 cSt; and a second high viscosity base oil having a kinematic viscosity at 100° C. ranging from about 6 cSt to about 17 cSt.

There is also disclosed herein a method of lubricating an automotive engine, said method comprising adding to and operating in the crankcase of said automotive engine a lubricating composition comprising a first base oil having a kinematic viscosity at 100° C. ranging from about 3.5 cSt to about 6 cSt; and a second high viscosity base oil having a kinematic viscosity at 100° C. ranging from about 6 cSt to about 17 cSt.

EXAMPLES

Various lubricating compositions were formulated with the treat rates as shown in Table 1 and subjected to a Sequence IIIG test. The viscosity grade of Examples A through F was SAE 5W-20.

A 1996/1997 General Motors Powertrain 3800 Series II, water-cooled, 4-cycle, V-6 engine was used as the test apparatus in the Sequence IIIG test. During the test, a 10-minute operational check was followed by 100 hours of engine operation at 125 bhp, 3600 rpm, and 150° C. oil temperature. The 100-hour segment was broken into five 20-hour test segments. Following each 20-hour segment, and the 10-minute operational check, oil samples were drawn from the engine and tested. The kinematic viscosities of the 20-hour segments were compared to the viscosity of the 10-minute sample to determine the viscosity increase of the test oil. At the end of the test, all six pistons were rated for deposits and varnish; cam lobes were rated for wear, and oil screen plugging was evaluated. The Sequence IIIG passing requirements are described below:

| | |
|---|---|
| Kinematic Viscosity Increase at 40° C. | 150% Max |
| Avg. Weighted Piston Deposits, merits | 3.5 Min |
| Avg. Cam & Lifter Wear | 60 μm Max |
| Oil Consumption | 4.65 L Max |
| Hot Stuck Rings | None |

The results are shown in Table 1 below.

TABLE 1

| | | EXAMPLES | | | | | |
|---|---|---|---|---|---|---|---|
| | | A | B | C | D | E | F |
| | | Dispersants | | | | | |
| | Dispersant 1 | 3.20 | 3.20 | 3.20 | 3.20 | 3.20 | 3.20 |
| | Dispersant 2 | 1.20 | 1.20 | 1.20 | 1.20 | 1.20 | 1.20 |
| | | Detergents | | | | | |
| | Ca detergent 1 | 1.20 | 1.20 | 1.20 | 1.20 | 1.20 | 1.20 |
| | Ca detergent 2 | 0.60 | 0.60 | 0.60 | 0.60 | 0.60 | 0.60 |
| ZDDP | Mixed ZDDP | 0.93 | 0.93 | 0.93 | 0.93 | 0.93 | 0.93 |
| | | Antioxidant | | | | | |
| | Antioxidant 1 | 0.80 | 0.80 | 0.80 | 0.80 | 0.80 | 0.80 |
| | Antioxidant 2 | 0.74 | 0.77 | 0.91 | 1.20 | 0.76 | 0.80 |
| | | Antifoam Agent | | | | | |
| | Silicone antifoamant | 0.006 | 0.006 | 0.006 | 0.006 | 0.006 | 0.006 |
| | | Diluent | | | | | |
| | Mineral oil | 0.564 | 0.564 | 0.564 | 0.564 | 0.564 | 0.564 |
| | | Friction Modifier | | | | | |
| | Fatty acid ester | 0.30 | 0.30 | 0.35 | 0.35 | 0.30 | 0.30 |
| | | Antiwear Agent | | | | | |
| | Organomolybdenum compound | 0.05 | 0.05 | 0.05 | 0.05 | 0.05 | 0.05 |
| | | VI Improver | | | | | |
| | Olefin copolymer | 4.60 | 4.50 | 4.20 | 4.20 | 3.70 | 4.00 |
| | | Pour Point Depressant | | | | | |
| | Polyalkylmethacrylate | 0.50 | 0.50 | 0.50 | 0.50 | 0.50 | 0.50 |
| | | Base Oil | | | | | |
| | Group II+, 5 cSt | 70.31 | 65.38 | 65.49 | 65.20 | 51.19 | 68.30 |
| | Group II, 6 cSt | 15.00 | 20.00 | 20.00 | 20.00 | 25.00 | 7.50 |
| | Group II, 12 cSt | | | | | | 10.00 |
| | Group III, 6 cSt | | | | | 10.00 | |
| Sequence IIIG Results | | FAIL | FAIL | FAIL | FAIL | PASS | PASS |
| Kinematic Viscosity Increase @ 40° C. | 150% Max | 203 | 426 | 180 | 203 | 109 | 106 |
| Avg. Weighted Piston Deposits, merits | 3.5 Min | 3.0 | 2.6 | 3.7 | 3.1 | 3.5 | 4.8 |
| Avg. Cam & Lifter Wear | 60 μm Max | 30 | 25 | 11 | 24 | 19 | 6 |
| Oil Consumption | 4.65 L Max | 4.51 | 4.44 | 3.97 | 3.94 | 3.22 | 3.76 |
| Hot Struck Rings | None | 0 | 0 | 0 | 0 | 0 | 0 |

Examples A, B, C and D were attempts to improve test performances by increase in Antioxidant 2 levels, an approach commonly used to boost oxidation control in engine tests and/or mid-viscosity base oils. In Examples C and D, friction modifier levels were also increased to improve test performance, yet none of Examples A through D met all minimum requirements of the Sequence IIIG test.

However, overall passing results were obtained from Example E by incorporating 10% of a 6 cSt Group IIII base oil, and also from Example F by incorporating 10% of a 12 cSt Group II base oil, without significant uptreat of antioxidants or friction modifier levels. Moreover, Example F, which achieved the best overall results, utilized a Group II base oil, which is typically less expensive than a Group III base oil. It should also be noted that the performance level of Example F in essence met the Sequence IIIG requirements in the proposed GM GEOS A specification, which requires that the Sequence IIIG test achieves a minimum weighted piston deposit performance of 4.5.

Therefore, it can be seen that adding a minor amount of a heavy base oil to the lubricating composition clearly improves the ability of the composition to control increases in oil viscosity and piston cleanliness.

What is claimed is:

1. A lubricating composition comprising:

a first base oil having a kinematic viscosity at 100° C. ranging from about 3.5 cSt to about 6 cSt; and from about 5% to about 15% of a second high viscosity base oil having a kinematic viscosity at 100° C. ranging from about 6 cSt to about 17 cSt; and wherein the lubricating composition is substantially free of Group IV base oils.

2. The lubricating composition of claim 1, wherein the second high viscosity base oil has a kinematic viscosity at 100° C. ranging from about 8 to about 14 cSt.

3. The lubricating composition of claim 1, wherein the first and second base oils are each independently selected from the group consisting of Group I, Group II, Group III, and mixtures thereof.

4. The lubricating composition of claim 1, wherein the second high viscosity base oil is selected from the group consisting of Group II, Group II+ base oils, and mixtures thereof.

5. The lubricating composition of claim 1, wherein the lubricating composition is substantially free of Group III, and Group V base oils.

6. The lubricating composition of claim 1, further comprising at least one additive selected from the group consisting of antiwear agents, friction modifiers, antioxidants, dispersants, detergents, rust inhibitors, corrosion inhibitors, demulsifiers, pour point depressants, viscosity index improvers, antifoaming agents, seal swell agents, and dispersant-inhibitor packages.

7. The lubricating composition of claim 1, wherein the lubricating composition exhibits reduced deposit formation, as compared to a lubricating composition devoid of the second high viscosity base oil.

8. A method of controlling oil thickening of a lubricating composition, said method comprising admixing a major amount of a first base oil having a kinematic viscosity at 100° C. ranging from about 3.5 cSt to about 6 cSt with from about 5% to about 15% of a second high viscosity base oil having a kinematic viscosity at 100° C. ranging from about 6 cSt to about 17 cSt; and wherein the lubricating composition is substantially free of Group IV base oils.

9. The method of claim 8, wherein the second high viscosity base oil is selected from the group consisting of Group II and Group II+ base oils.

10. A method of controlling piston deposit formation, said method comprising providing to the pistons in an automotive engine a lubricating composition comprising:

a major amount of a first base oil having a kinematic viscosity at 100° C. ranging from about 3.5 cSt to about 6 cSt; and from about 5% to about 15% of a second high viscosity base oil having a kinematic viscosity at 100° C. ranging from about 6 cSt to about 17 cSt; and wherein the lubricating composition is substantially free of Group IV base oils.

11. The method of claim 10, wherein the second high viscosity base oil is selected from the group consisting of Group II and Group II+ base oils.

12. A method of reducing valve train wear, said method comprising providing to the valve train of an automotive engine a lubricating composition comprising:

a major amount of a first base oil having a kinematic viscosity at 100° C. ranging from about 3.5 cSt to about 6 cSt; and from about 5% to about 15% of a second high viscosity base oil having a kinematic viscosity at 100° C. ranging from about 6 cSt to about 17 cSt; and wherein the lubricating composition is substantially free of Group IV base oils.

13. The method of claim 12, wherein the second high viscosity base oil is selected from the group consisting of Group II and Group II+ base oils.

14. A method of lubricating an automotive engine, said method comprising adding to and operating in the crankcase of said automotive engine a lubricating composition comprising:

a major amount of a first base oil having a kinematic viscosity at 100° C. ranging from about 3.5 cSt to about 6 cSt; and from about 5% to about 15% of a second high viscosity base oil having a kinematic viscosity at 100° C. ranging from about 6 cSt to about 17 cSt; and wherein the lubricating composition is substantially free of Group IV base oils.

15. The method of claim 14, wherein the second high viscosity base oil is selected from the group consisting of Group II and Group II+ base oils.

* * * * *